US007187335B2

(12) United States Patent
Vincent

(10) Patent No.: US 7,187,335 B2
(45) Date of Patent: Mar. 6, 2007

(54) SYSTEM AND METHOD FOR PROVIDING A DISTRIBUTED LOADED MONOPOLE ANTENNA

(75) Inventor: Robert J. Vincent, Warwick, RI (US)

(73) Assignee: The Board of Governors for Higher Education, State of Rhode Island and Providence Plantations, Providence, RI (US)

( * ) Notice: Subject to any disclaimer, the term of this patent is extended or adjusted under 35 U.S.C. 154(b) by 0 days.

(21) Appl. No.: 11/139,284

(22) Filed: May 27, 2005

(65) Prior Publication Data

US 2006/0022883 A1 Feb. 2, 2006

Related U.S. Application Data

(63) Continuation of application No. PCT/US2004/020556, filed on Jun. 25, 2004.

(60) Provisional application No. 60/576,847, filed on Jun. 3, 2004, provisional application No. 60/498,089, filed on Aug. 27, 2003, provisional application No. 60/482,421, filed on Jun. 25, 2003.

(51) Int. Cl.
*H01Q 1/00* (2006.01)

(52) U.S. Cl. ..... 343/722; 343/749; 343/841

(58) Field of Classification Search ..... 343/722, 343/749, 715, 752, 841
See application file for complete search history.

(56) References Cited

U.S. PATENT DOCUMENTS 3,984,839 A * 10/1976 Ray, Jr. ..... 343/749
4,095,229 A 6/1978 Elliott
4,229,743 A 10/1980 Vo et al.
4,442,436 A * 4/1984 Newcomb ..... 343/722
4,564,843 A 1/1986 Cooper
4,734,703 A 3/1988 Nakase et al.
5,016,021 A 5/1991 Newcomb
5,065,164 A * 11/1991 Deasy ..... 343/749
5,134,419 A 7/1992 Egashira
5,406,296 A * 4/1995 Egashira et al. ..... 343/715
5,521,607 A 5/1996 Deasy
5,856,808 A 1/1999 Holshouser et al.
5,955,996 A 9/1999 Clubb
6,054,958 A 4/2000 Holshouser et al.
6,208,306 B1 3/2001 McLean et al.
6,437,756 B1 8/2002 Schantz
6,791,504 B1 9/2004 Miller et al.

OTHER PUBLICATIONS

Harrison, Jr., "Monopole with Inductive Loading," IEEE Transactions on Antennas and Propagation, Sandia Corporation, Albuquerque, NM, Dec. 26, 1962, pp. 394-400.
Fujimoto et al., "Small Antennas," Research Studies Press Ltd., Letchworth, Hertfordshire, England & John Wiley & Sons Inc., New York, 1987, pp. 59-75.

(Continued)

*Primary Examiner*—Tho Phan
(74) *Attorney, Agent, or Firm*—Gauthier & Connors

(57) ABSTRACT

A distributed loaded antenna system including a monopole antenna is disclosed. The antenna system includes a radiation resistance unit coupled to a transmitter base, a current enhancing unit for enhancing current through the radiation resistance unit, and a conductive mid-section intermediate the radiation resistance unit and the current enhancing unit. The conductive mid-section has a length that provides that a sufficient average current is provided over the length of the antenna.

29 Claims, 18 Drawing Sheets

OTHER PUBLICATIONS

"Now You're Talking!: All You Need to Get Your First Ham Radio License," The American Radio Relay League, Inc., Second Edition, Apr. 1996, Chapter 7, pp. 16-17.

"The Offset Multiband Trapless Antenna (OMTA)," QST, vol. 79, No. 10, American Radio Relay League, Inc., 1996, pp. 1-11.

"Mounting Tips for the Stealth II Series HF Mobile Antennas," Version 3.32, Aug. 2002, pp. 1-9.

Nakano et al., "A Monofilar Spiral Antenna Excited Through a Helical Wire," IEEE Transactions of Antennas and Propagation, vol. 51, No. 3, Mar. 2003, pp. 661-664.

"Helix Antenna," http://library.kmitnb.ac.th/projects/eng/EE/ee0003e.html, no dated?.

T. Simpson, "The Dick Loaded Monopole Antenna," IEEE Transactions of Antennas and Propagation, vol. 52, No. 2, Feb. 2004, pp. 542-545.

* cited by examiner

SYSTEM AND METHOD FOR PROVIDING A DISTRIBUTED LOADED MONOPOLE ANTENNA

PRIORITY

The present application is a continuation application of Patent Cooperation Treaty (PCT) Application No. PCT/US2004/020556 filed with the United States Patent and Trademark Office on Jun. 25, 2004, which claims priority to U.S. Provisional Patent Application Ser. No. 60/482,421 filed Jun. 25, 2003, and claims priority to U.S. Provisional Patent Application Ser. No. 60/498,089 filed Aug. 27, 2003, and claims priority to U.S. Provisional Patent Application Ser. No. 60/576,847 filed Jun. 3, 2004.

BACKGROUND

The present invention generally relates to antennas, and relates in particular to antenna systems that include one or more monopole antennas.

Monopole antennas typically include a single pole that may include additional elements with the pole. Non-monopole antennas generally include antenna structures that form two or three dimensional shapes such as diamonds, squares, circles etc.

As wireless communication systems (such as wireless telephones and wireless networks) become more ubiquitous, the need for smaller and more efficient antennas such as monopole antennas (both large and small) increases. Many monopole antennas operate at very low efficiency yet provide satisfactory results. In order to meet the demand for smaller and more efficient antennas, the efficiency of such antennas must improve.

There is a need, therefore, for more efficient and cost effective implementation of a monopole antenna, as well as other types of antennas and antenna systems.

SUMMARY OF THE INVENTION

In accordance with an embodiment, the invention provides a distributed loaded antenna system including a monopole antenna. The antenna system includes a radiation resistance unit coupled to a transmitter base, a current enhancing unit for enhancing current through the radiation resistance unit, and a conductive mid-section intermediate the radiation resistance unit and the current enhancing unit. The conductive mid-section has a length that provides that a sufficient average current is provided over the length of the antenna.

BRIEF DESCRIPTION OF THE DRAWINGS

The following description may be further understood with reference to the accompanying drawings in which.

The drawings are shown for illustrative purposes only.

DETAILED DESCRIPTION OF THE ILLUSTRATED EMBODIMENTS

A distributed loaded monopole antenna in accordance with an embodiment of the invention includes a radiation resistance unit for providing significant radiation resistance, and a current enhancing unit for enhancing the current through the radiation enhancing unit. In certain embodiments, the radiation resistance unit may include a coil in the shape of a helix, and the current enhancing unit may include load coil and/or a top unit formed as a coil or hub and spoke arrangement. The radiation resistance unit is positioned between the current enhancing unit and a base (e.g., ground), and may, for example, be separated from the current enhancing unit by a distance of $2.5316\times10^{-2}\lambda$ of the operating frequency of the antenna to provide a desired current distribution over the length of the antenna.

Figure 1:
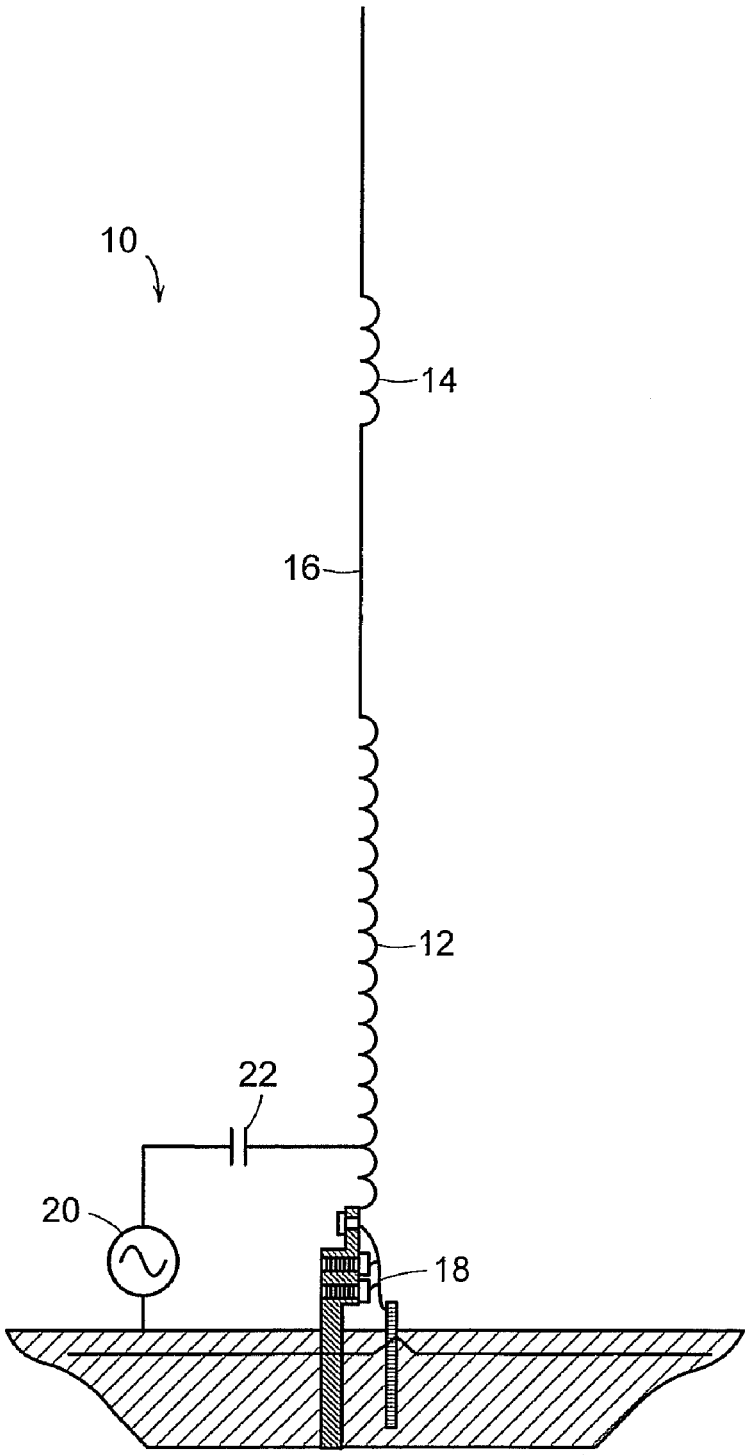
FIG. 1 shows a diagrammatic illustrative electrical schematic view of a distributed loaded monopole antenna in accordance with an embodiment of the invention.

As shown in FIG. 1, an electrical schematic diagram of an antenna 10 in accordance with an embodiment of the invention includes a radiation resistance unit 12 and a current enhancing unit 14. The radiation resistance unit 12 (such as, for example, a helix) may be formed in a variety of shapes, including but not limited to round, rectangular, flat and triangular. The radiation resistance unit 12 may be wound with wire, copper braid or copper strap or other conductive material around the form and is such that it's length is very much longer than it's width or diameter.

The current enhancing unit 14 may also be formed of a variety of conductive materials and may be formed in a variety of shapes. The unit 14 is positioned above the unit 12 and is separated a distance above the unit 12 and supported by a mid-section 16 (e.g., aluminum tubing). The current enhancing unit 14 when placed a distance above the radiation resistance unit 12 performs several important functions. These functions include raising the radiation resistance of the helix and the overall antenna.

The above antenna provides continuous electrical continuity from the base of the helix to the top of the antenna. The base of the antenna is grounded as shown at 18, and the signal to be transmitted may be provided at any point along the radiation resistance unit 12 (e.g., near but not at the bottom of the unit 12). The signal may also be optionally passed through a capacitor 22 in certain embodiments to tune out excessive inductive reactance as discussed further below.

Figure 2:
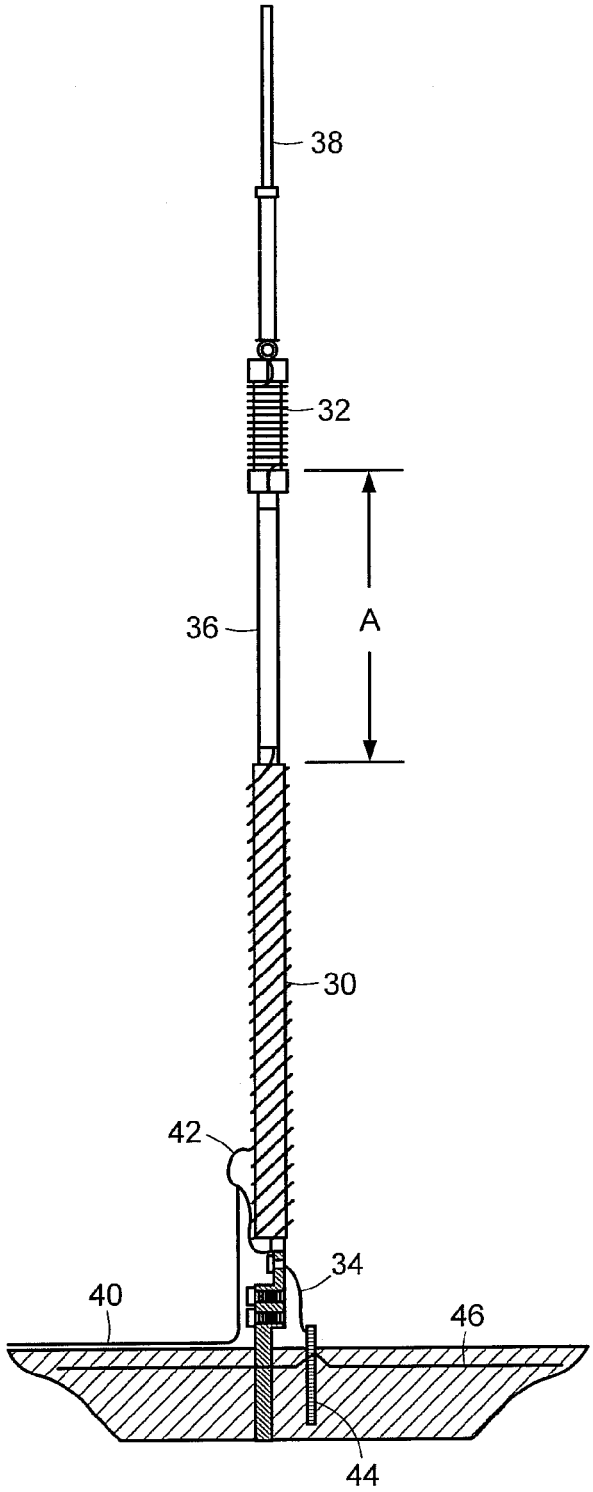
FIG. 2 shows a diagrammatic illustrative side view of a distributed loaded monopole antenna in accordance with an embodiment of the invention.

FIG. 2 shows an implementation of the above antenna system in which the radiation resistance unit is formed as a helix 30, and the current enhancing unit is formed as a load coil 32. The helix 30 is formed as a conductive coil that is wrapped around a non-conductive cylinder wherein the coil windings are mutually spaced from one another by a distance of approximately the thickness of the coil. The bottom of the helix coil is connected to ground as shown at 34, and the top of the helix coil is connected to a conductive mid-section 36 between the helix 30 and the load coil 32. The load coil is formed as a tightly wrapped spiral, the base of which is connected to the mid-section 36 and the top of which is connected to a top-section 38. The mid-section 36 may separate the helix 30 and load coil 32 by a distance as indicated at A. The signal to be transmitted is coupled to the antenna by a coaxial cable 40 whose signal conductor is coupled to one of the lower helix coil windings near the base as shown at 42, and whose outer ground conductor is coupled to ground as shown.

Figure 3:
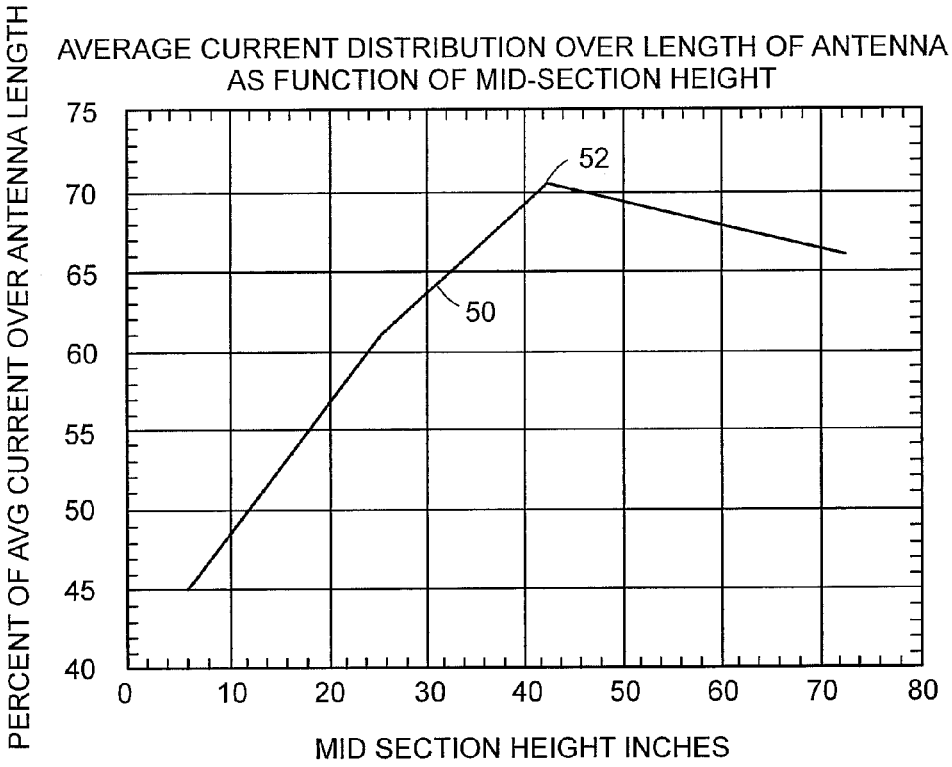
FIG. 3 shows a diagrammatic illustrative graphical view of average current distribution over length of an antenna in accordance with an embodiment of the invention.

The choice of the distance A of the load coil above the helix impacts the average current distribution along the length of the antenna. As shown in FIG. 3, the average current distribution over the length of the antenna varies as a function of the mid-section distance for a 7 MHz distributed loaded monopole antenna. The mid-section distance is shown along the horizontal axis in inches, and the percent of average current over the antenna length is shown along the vertical axis. The relationship between the mid-section distance and the percent of average current is shown at 50 for this antenna. The current distribution for this antenna peaks at about 42 inches as shown at 52. The conductive mid-section has a length that provides that a sufficient average current is provided over the length of the antenna and provides for increasing radiation resistance to that of 2 to nearly 3 times greater than a ¼λ antenna (i.e., from for example, 36.5 Ohms to about 72–100 Ohms or more).

The inductance of the load coil should be larger than the inductance of the helix. For example, the ratio of load coil inductance to helix inductance may be in the range of about 1.1 to about 2.0, and may preferably by about 1.4 to about 1.7. In addition to providing an improvement in radiation efficiency of a helix and the antenna as a whole, placing the load coil above the helix for any given location improves the bandwidth of the antenna as well as improving the radiation current profile. The helix and load coil combination are responsible for decreasing the size of the antenna while improving the efficiency and bandwidth of the overall antenna.

Figure 4:
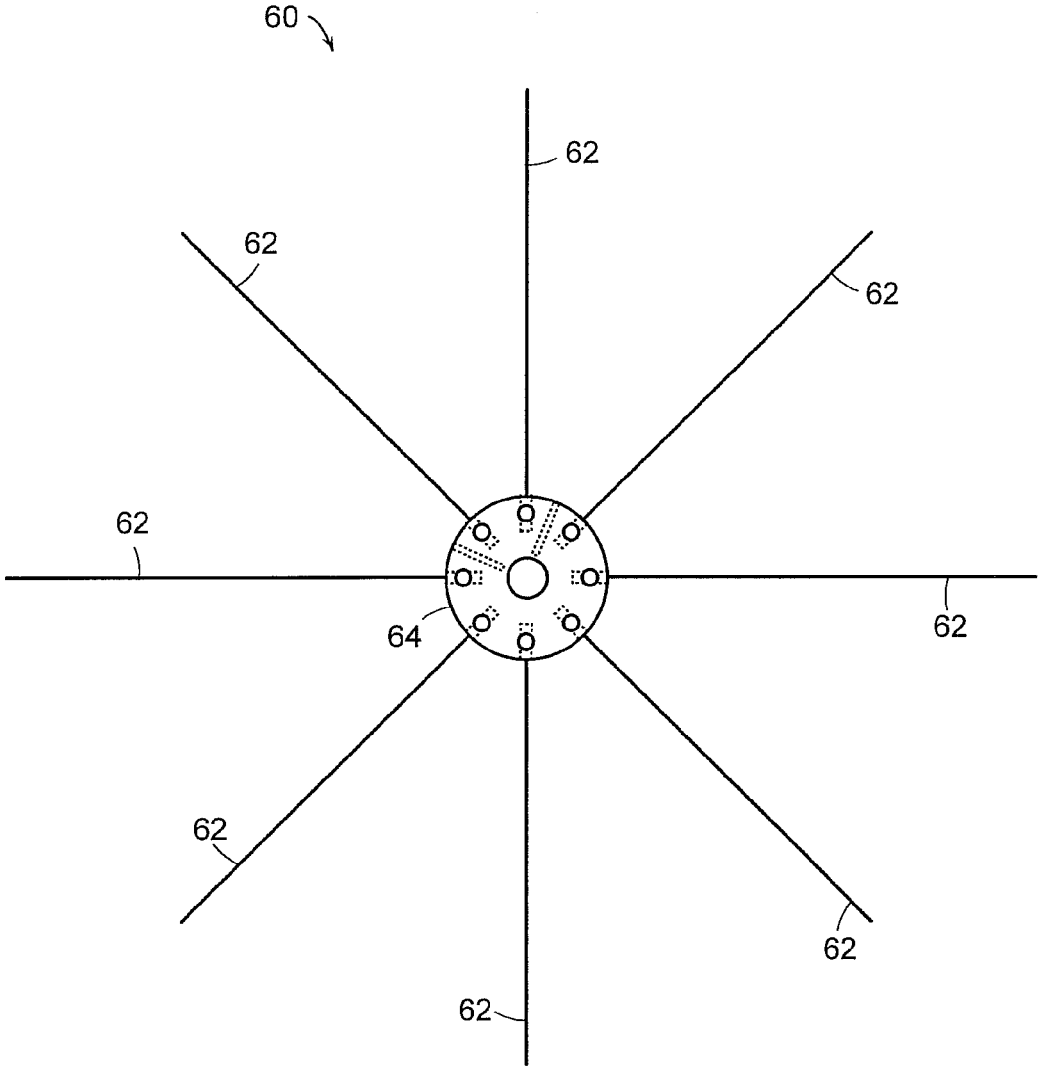
FIG. 4 shows a diagrammatic illustrative top view of a top unit for use in accordance with an embodiment of the invention.
Figure 5:
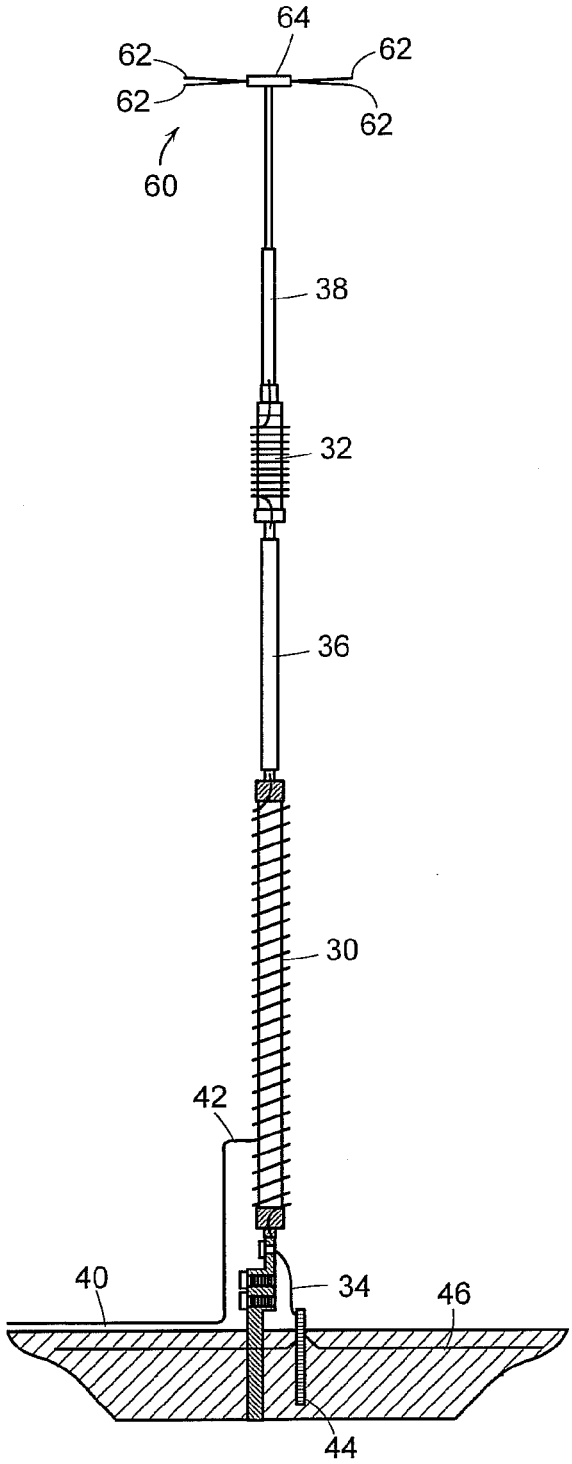
FIG. 5 shows a diagrammatic illustrative side view of an antenna in accordance with an embodiment of the invention employing a top unit as shown in FIG. 5.

In further embodiments, a top unit 60 may also be provided that includes eight conductive spokes 62 that extend from a conductive hub 64 as shown in FIG. 4. The spokes 62 may be held within small holes by set screws through which they are electrically connected to the conductive top-section 38 of the antenna. As shown in FIG. 5, the top unit 60 may be placed atop an antenna such as the antenna shown in FIG. 2. This may further reduce the inductive loading of the helix and load coil to allow even wider bandwidth and greater efficiency. The top unit is included as part of the current enhancing unit. In further embodiments, the top unit may be used in place of the load coil as the current enhancing unit.

A current profile for a 12 foot antenna employing a helix and load coil (starting at 7.5 feet) was found to show 100 percent current up to an elevation of about 7 feet, while a similar 9.5 foot antenna using an additional top unit was found to show 100 percent current up to an elevation of about 8 feet. The structure provides electrical continuity from the base of the helix to the top of the top section. The top unit may, in further embodiments, include a planar spiral winding that extends radially from, and in a transverse direction with respect to, the antenna as discussed below in connection with FIG. 6.

There is an electrical connection from the bottom of the helix up through the helix and through the midsection and continues through the load coil to the top section. The helix at the bottom has provisions for tapping the turns of the helix. This allows connection from a source of radio frequency energy and proper matching by selecting the appropriate tap to facilitate maximum power transfer from the radio frequency source to the antenna. The placement of the load coil provides linear phase and amplitude responses through the bandwidth of the antenna and even beyond the normally usable bandwidth of the antenna. It has also been found that such an antenna has no harmonic response, and that its response is similar to that of a low Q band pass filter.

The antenna shown in FIG. 2 may be mounted by clamping the base of the helix to a mounting pole that has been driven into the ground. Clamps may be used to affix the antenna sufficiently to the ground mounting post. In this embodiment the antenna is shown grounded to earth through a grounding rod, ground wire and connected to the base of the antenna and electrically connected using a ground clamp. Radial wires extending above ground or buried in the ground are electrically connected to the antenna using the ground wire and the ground rod and extend out from the antenna base for a uniform distance but not limited to any specific length. This grounding system comprised of a ground rod and radial wires may also take on many forms such as a large piece of copper or other conductor screen of any given geometric shape. This grounding system may also take on the form of a metal plane such as a ship, automobile, or a metal roof of a building among others. The antenna may also be elevated above ground on a conductive post with radial wires extended as guy wires to support and keep antenna in the upward erect position. These guy wires serve as an elevated ground poise or radial system.

The feed for the antenna from a radio frequency source is tapped a few turns from the base of the helix driven by a radio frequency source and connected by a coax cable. The shield of the coax cable is connected to the base of the helix which is grounded to the ground rod. The radio frequency source is used to excite the antenna and cause a radio frequency current to flow which causes the distributed loaded monopole antenna to radiate.

As indicated above, the design of the helix and interaction of the load coil are such that the antenna exhibits a large and uniform current distribution for various lengths along the antenna. The length and uniformity of this current profile is dependent upon the ratios of inductance between the load coil and the helix as well as location of placement of the load coil above the helix. In addition, the placement of the load coil allows larger than normal bandwidth measured as deviation from resonant frequency either side of resonance in which sufficient match between the source of radio frequency energy and the antenna can be maintained to allow the antenna to radiate with reasonable efficiency. In addition, the interaction of the helix and load coil allows reduction of the physical height of the overall antenna without reducing electrical height and provides for an increase in radiation resistance. This increase in radiation resistance reduces the effect of losses associated with short antennas. These losses include resistance in the wires of the helix and load coil and Ohmic resistance of the antenna conductors and that of the ground system. All or any of these has a pronounced effect on antenna radiating efficiency, reduction of antenna bandwidth and overall performance in shortened antennas. The design of the distributed loaded monopole antenna with a helix and load coil above the helix overcomes those losses and provides a high level of radiating efficiency with excellent bandwidth in a small compact easily implemented antenna.

The physical structure of an antenna and the interaction of the components as described above allow for maximum use of distributed capacity along the antenna to ground to reduce inductive loading required to resonate the antenna to a given desired radio frequency. This increases efficiency, raises radiation resistance and improves bandwidth. This also allows the antenna to have amplitude and phase response through resonance that resembles a universal resonance response curve with linear deviations in amplitude and phase for bandwidths far exceeding the normal half power bandwidth of the antenna.

The antenna of FIG. 5 may be formed as follows. A helix is formed by wrapping a conductive material around a tubular non-conductive form, such as fiberglass, PVC or other suitable tubular insulator. In further embodiments, any form may be used such as those that are also square, rectangle or triangular in cross section. Attached to the top of the helix is a top fitting that is formed of a conductive material such as aluminum or other suitable conductive material. In this embodiment these are machined but can also be cast from aluminum or other suitable conductive material. Slots are cut in the top fitting to allow clamping on to a aluminum tubing of such diameter that they form a tight mechanical fit when such tubing is inserted. This fitting is inserted into the helix tube and in this embodiment is epoxy bonded together with the helix and fitting. It may also be fastened with machine screws provided the helix form is drilled and the fitting has been drilled and threaded. Likewise a bottom helix fitting is machined or cast of aluminum or other conductive material is attached to bottom of helix. This fitting is solid aluminum and has mounting rod. A helix insertion rod has been epoxy bonded to the helix form. The main section forms a conductive mounting point for this lug and helix winding. A helix winding is attached at the base fitting with a solder lug or other conductive connecting material and fastened electrically and mechanically to the helix end fitting with a machine screw. The helix is wound with copper strap but not limited to this material but can be wire or copper braid wound in a circular manner over the entire length of the helix form and attached to the helix top fitting using, for example, a solder lug. Other conductive connecting devices may be used to allow electrical and mechanical assembly with a machine screw into the drilled and threaded hole. The helix at the bottom has machine nuts or similar connecting devices soldered to the winding for attachment of the center conductor of a coax cable.

Inserted into the top of the helix fitting is a tubing that is held rigidly in the helix top fitting using a clamp. The load coil includes a section of fiberglass tubing that is attached with end fittings that are epoxy bonded to form a strong mechanical connection with both the mid-section and the top-section. The load coil end fittings are machined or cast aluminum. Each of these fittings is slotted and formed, or machined to accept mid-section tubing or top section tubing, which are electrically connected to the load coil itself. The load coil form is wound with heavy copper wire but may be any other heavy conductive material that is closely wound as shown to form a solenoid. Each end is connected to the load coil end fitting with a lug on each end, and attached electrically and mechanically with machine screws that are screwed into holes that have been drilled and threaded into load coil end fittings. Two pieces of tubing form the top section. The lower tube section at the top has been slotted to allow the upper tubing section to be inserted in a telescoping manner into tubing section to permit adjustment of the overall top section length to tune the antenna. Once adjusted, the tubing sections are secured with a clamp to form a rigid mechanical and electrical connection. There is now an electrical connection from the bottom of the helix winding from the helix bottom fitting to the top of the top section.

The completed distributed loaded monopole antenna consisting of the helix 30, the mid-section 36, the load coil 32 and the top section 38 is shown in FIG. 5 mounted on a ground mounting pipe of conductive material using clamps. The coax cable with a center conductor is shown connected to one of the tap points at bottom of helix. The coax shield is electrically connected to the helix base fitting with an electrical clamp. The ground wire 34 is connected to the electrical clamp (and therefore to the ground base of helix) and to a ground rod 44 in the ground. Attached to the ground rod 44 and ground wire are radials 46 that are either buried or lying on the ground. The radials 46 may be of sufficient length and number to provide an adequate counterpoise for operation of the distributed loaded monopole antenna.

The hub 64 of the hub and spoke top unit 60 shown in FIG. 4 may be fabricated from an aluminum disk of sufficient size to accommodate the eight radial aluminum conductors or spokes 62. To use the top unit 60, the normal antenna design inductance for the helix and load coil must be decreased by ½ in order to resonate the antenna to the same frequency. The overall antenna height decreases by about 25%. The bandwidth of the antenna increases by a factor of 2.5 times or more over that of a normal design. In addition the antenna increases in efficiency by more than 10% as compared to a normal distributed loaded monopole design.

The top unit hub 64 is drilled with eight holes spaced every 45 degrees around the circumference of sufficient diameter and depth to accept the conductive radial spokes 62. Eight holes are also drilled in the top of the hub along the outer rim and are aligned over the eight holes previously drilled and are threaded to accept set screws that secure the radial conductive spokes 62. All the spokes 62 are of the same length and of sufficient diameter and strength to be self-supporting extending horizontally out from the hub as shown in FIG. 5. The complete top unit with hub and spokes is slipped over the top section of the distributed loaded monopole antenna and horizontally extends in all directions as shown in FIG. 5. The antenna is tuned by decreasing or extending the height of the top unit above the load coil of the antenna. The top unit is provided to maximize and make uniform the current profile of the antenna from the base to as high along the antenna length as possible while providing improved bandwidth and efficiency.

Figure 6:
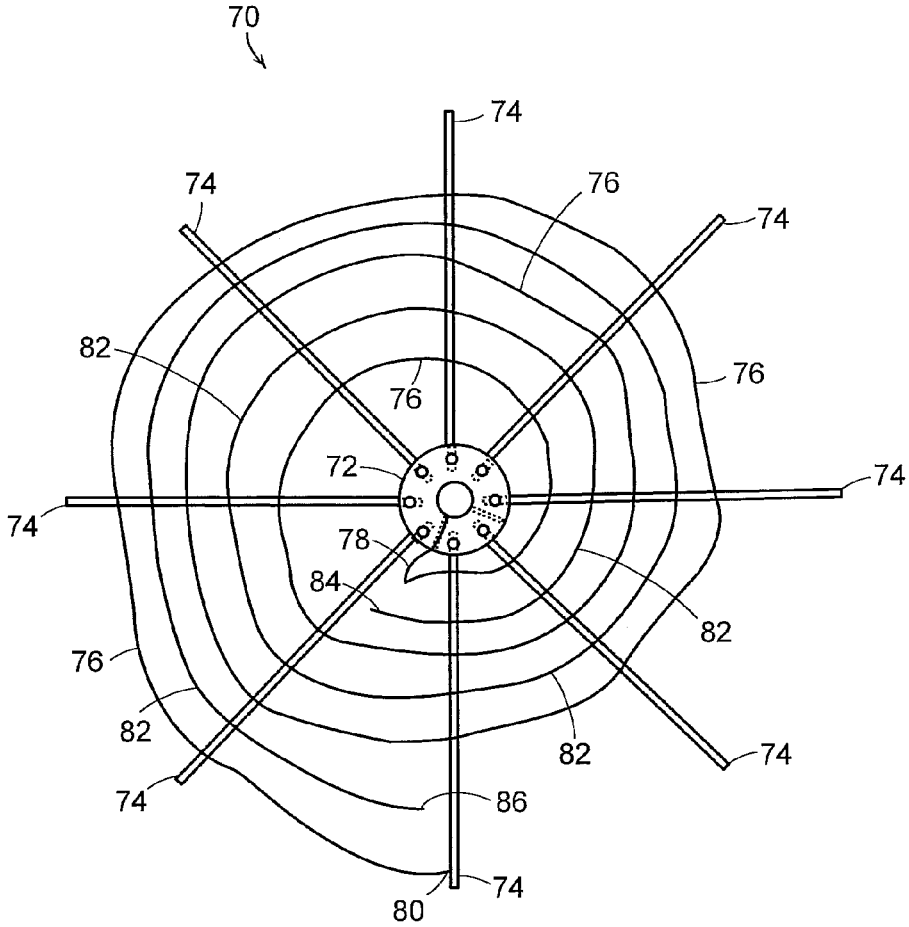
FIG. 6 shows a diagrammatic illustrative top view of another top unit for use in an antenna in accordance with a further embodiment of the invention.

In other embodiments, the top unit 70 may include a non-conductive hub 72 with eight non-conductive rods 74 extending from the center-insulated hub 72 as shown in FIG. 6. These rods may be formed of an insulating material that may be used for radio frequencies. The top section extends through the hub 72 and is then connected to a large conductor or wire 76 at a first end 78 of the wire. The other end 80 of the wire is not electrically connected to any conductive material. This wire 76 is wound in a spiral form from the center in an increasing diameter. This forms a large spiral conductor at the very top of the antenna as well as provides capacitive loading. The function of this configuration is to maximize and make uniform the current profile from the base of the antenna extending all the way to the top of the antenna.

When using the top unit 70 with a load coil and helix of the antenna shown in FIG. 2, the inductance for the helix and the load coil must be reduced by about ½(50%). This will allow the antenna to resonate at the same frequency.

For the combined capacitive top unit and load coil of FIG. 5, the load coil and helix inductance is also reduced by about 50%. The overall antenna height decreases by about 25% for the capacitive top unit antenna and for the combined load inductor and top unit combination the antenna height remains the same or in some cases may be slightly larger.

Figure 7:
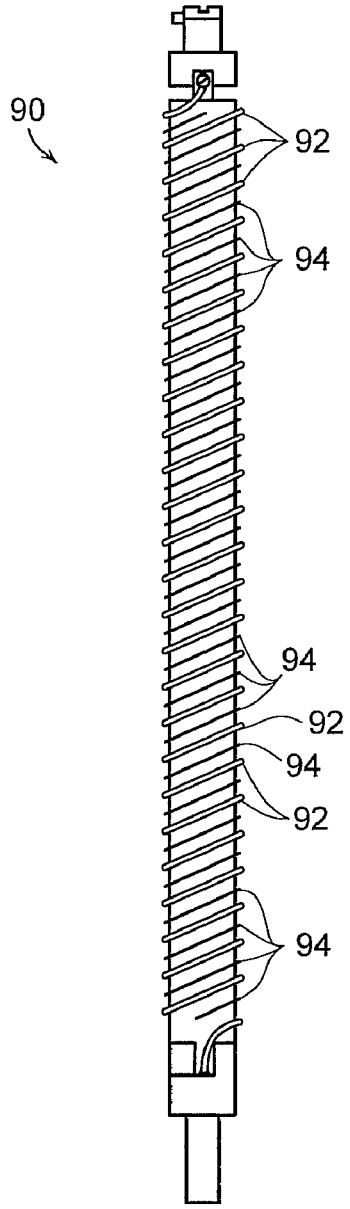
FIG. 7 shows a diagrammatic illustrative side view of a radiation resistance unit for use in an antenna in accordance with an embodiment of the invention.
Figure 10B:
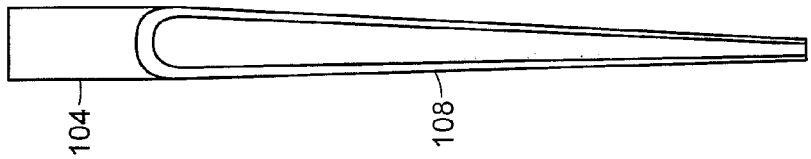
FIGS. 10A and 10B show diagrammatic illustrative side views of the tapered sleeve shown in FIG. 8.
Figure 10A:
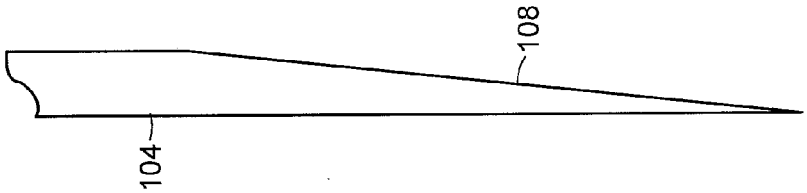

In further embodiments, the bandwidth of the antenna may be enhanced by including an additional coiled wire 82 in a top unit as also shown in FIG. 6. The additional wire 82 includes first and second ends 84 and 86 that are each not electrically connected to any conductive material. It has been found that interlacing a false winding into a current enhancing unit (such as the top unit winding shown in FIG. 6) or a radiation resistance unit (such as a helix as shown in FIG. 7) enhances the bandwidth of the top unit as well as improves the current profile along the antenna. The interlaced false winding has little effect on the resonant frequency of the antenna system.

Similarly, a false winding may be provided in a helix of an antenna in accordance with an embodiment of the invention as shown in FIG. 7 to enhance the bandwidth of the helix. In this embodiment, a radiation resistance unit 90 includes a helix winding 92 that is wound around a non-conductive tube and electrically connected at each end to electrical couplings. An additional winding 94 is interlaced within the helix winding but is not connected electrically to any point within the helix or at the ends of the winding 94. The winding 94 is merely suspended within the helix winding 92 as shown in FIG. 7. This false winding 94 has been found to enhance the bandwidth of an antenna by as much as 100% (i.e., doubling it). The effect of this false winding is to reduce the capacitance between helix and load coil windings, which has been found to be a bandwidth limiting mechanism in helix coils and load coils.

Figure 9:
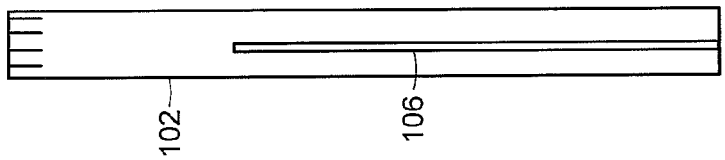
FIG. 9 shows a diagrammatic illustrative side view of the slotted tube shown in FIG. 8.
Figure 8:
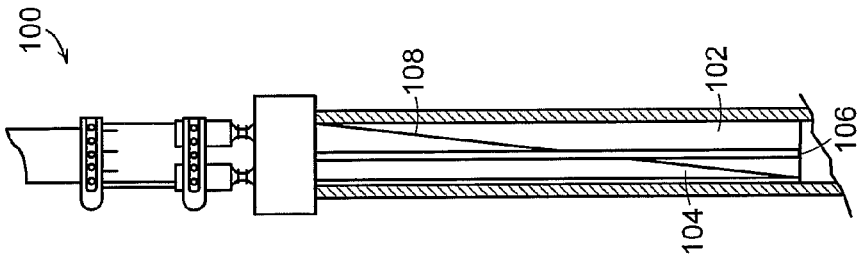
FIG. 8 shows a diagrammatic illustrative side view of an adjustment unit for use in an antenna in accordance with an embodiment of the invention.
Figure 13:
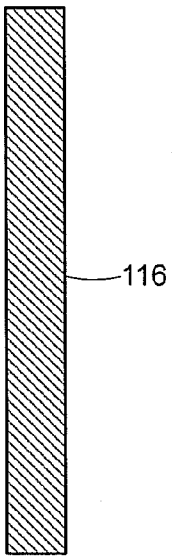
FIG. 13 shows a diagrammatic illustrative side view of the sleeve shown in FIG. 11.
Figure 12:
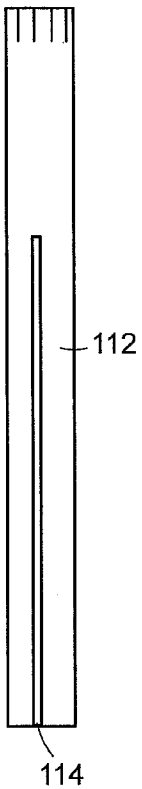
FIG. 12 shows a diagrammatic illustrative side view of the slotted tube shown in FIG. 11.
Figure 11:
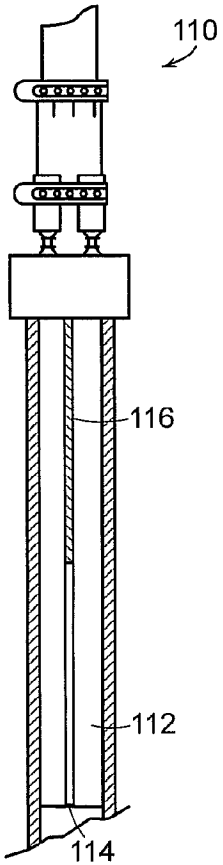
FIG. 11 shows a diagrammatic illustrative side view of another adjustment unit for use in an antenna in accordance with an embodiment of the invention.

In further embodiments, the resonance of an antenna of the invention that includes a helix may be changed by adding to or removing from the helix, a turn of winding turns of the helix to change coil inductance. This may be accomplished by employing a coil adjustment unit such as units 100 or 110 as shown in FIGS. 8 and 11 respectively. The coil adjustment unit 100 shown in FIG. 8 includes an electrically conductive slotted tubing 102 (shown in FIG. 9) that is received within the tubing of the helix, i.e., the tubing around which the helix coil (not shown) is wrapped. An electrically conductive tapered sleeve 104 is then inserted within the tubing 102. The slotted tubing 102 may be made from aluminum or any other non-ferrous conductive material. The slot 106 in the tubing 102 is cut lengthwise as shown and may be any convenient width but not greater than ⅙ of the tubing circumference. The top of this tubing should have slots cut to allow a clamp to securely fasten telescoping tubing to be inserted into tubing (102). The total length of this tubing should be such that the portion slotted will fit into the helix tubing and locked into the helix top fitting clamp assembly using a clamp as discussed above.

A portion of the tubing 102 should also protrude from the helix for the additional non-ferrous sleeve 104 to easily slide inside and be secured using a clamp. This sleeve 104 is cut lengthwise as shown to create a long angled section 108. This sleeve 104 when fitted into the slotted tubing 102 provides variations in opening or closing the slot responsive to turning the sleeve 104 with respect to the tubing 102. This permits eddy currents to circulate within this tubing combination where the slot has been closed by the twisting action of tubing. The effect of the slotted tubing when the slot is open is minimal on the helix inductance. When the slot is filled or closed by the rotation of the sleeve 104, eddy currents will be allowed to flow and electrically short out turns of the helix therefore allowing variations of the helix inductance. This same technique may be used for solenoid coils of any length thereby allowing adjustment of the inductance. The number of windings and/or the length of a load coil may also be adjusted using such an adjustment unit.

Similarly, the coil adjustment unit 110 shown in FIG. 11 includes an electrically conductive slotted tubing 112 having a slot 114, and a conductive sleeve 116. In this case the sleeve 116 does not include a tapered edge, and the unit 110 is adjusted by varying the distance to which the sleeve 116 is inserted within the slotted tubing 112. In both cases, once the adjustment has been made to satisfaction the adjusting tubing is clamped securely.

In addition to these embodiments, the distributed loaded monopole antenna may take on other forms. These include reducing the height of the antenna and inductance of the helix and load coil, and affixing at the top of the top section a horizontal series of electrical conductors extending out from the center in the form of spokes for a given distance. These conductors may be any arbitrary number and are arranged as spokes from a hub as discussed above. In accordance with further embodiments, a plain sheet of metal or conductive screen may also be used. Other such embodiments may also be employed where they provide for a large capacitance from the top of the antenna to ground. This capacitance provides for further uniform distribution of current for an even greater distance along the antenna height or length. This further allows for wider bandwidth operation and higher efficiency.

Further embodiments provide that a helix may be constructed as a lattice network of wider width than thickness as discussed below with reference to FIGS. 14–17. This embodiment may take on the form of a latticework constructed of insulating material that is adequately braced along its height or length. The ends of the latticework consist of fabricated aluminum pieces so shaped to support the lattice structure at each end. Winding suitable conductors as described above around the structure from the base to the top forms a helix. The winding is such that the number of turns per unit length is higher at the bottom than at the top. The top of this helix winding is electrically terminated to the conductive lattice termination. These aluminum pieces or suitable conductors provide for affixing additional conductors in the form of tubing, rod or pipe. In this manner, the antenna may be extended in length or height and provide for electrical connection of the helix winding. This extends the electrical connection from ground up through the helix to the top of the antenna through the load coil. The aluminum or any conductive material at the top of the helix structure allows for terminating the helix winding and provides electrical connection to the above mentioned upper structures of the antenna. These upper structures include a mid-section as discussed above. A load coil of any of a variety of geometric shapes may also be employed as further discussed below. To allow connection and proper matching between a radio frequency source and the antenna this above-described helix provision is allowed for tapping the helix conductor anywhere along its length from the bottom of the antenna. The rectangular helix geometry and various load coil geometry allow further reduction of required loading in the form of inductance and enhance further the distributed loading affect of capacity along the length of the antenna to ground. This allows even further improved bandwidth and radiation efficiency. This embodiment may also be used with variations in load coil inductance and helix length and helix inductance, together with a series capacitor match between helix tap and the source of radio frequency energy. These variations allow equivalent performance to a conventional antenna as much as 9 times larger in size.

Current profiles have been developed for various such embodiments of ½ wave and ⅝ wave distributed loaded monopole antennas. The manipulation of helix length and inductance as well as the ratio of load coil to helix inductance may achieve a wide variety of suitable antennas.

In addition to the above embodiments, providing a remotely controlled top section length may yield a distributed loaded monopole antenna that is continuously tunable over a large frequency range. This may be achieved utilizing a motor driven worm gear or any other method of varying remotely the adjustment of the top section length. Similarly the antenna may be tuned by varying the helix inductance. This may be accomplished by varying the electrical length of the helix but without changing the mid-section length between the helix top and load coil.

Figure 14:
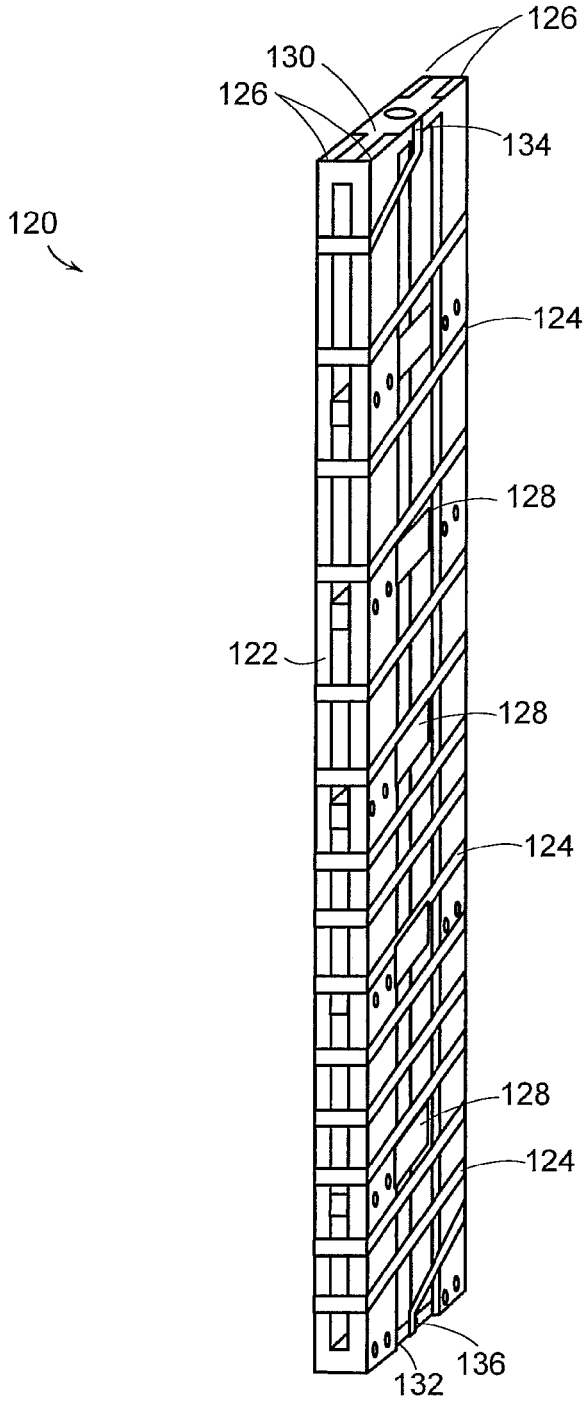
FIG. 14 shows a diagrammatic illustrative isometric view of a radiation resistance unit for use in an antenna in accordance with an embodiment of the invention.

In particular, an antenna in accordance with further embodiments may include a radiation resistance unit 120 having a non-electrically conductive structure 122 around which is wrapped a conductive material 124 in the form of a helix as shown in FIG. 14. The structure 122 may be provided by four elongated edge elements 126 that are each connected to internal non-conductive bridges 128. The end portions 130, 132 are conductive and are electrically connected to each of the ends 134, 136 respectively of the conductive material 124. Each of the bridge portions 128 includes a central hole through which a non-conductive tube may pass, and the conductive end portions 130, 132 also include such an opening as well as a clamp for attaching the unit 120 to the conductive mid-section of an antenna at the upper end of the unit 120 and to ground at the lower end of the unit 120. The mid-section may further include a reinforcing fiberglass rod.

The conductive material 124 may be any suitable conductor such as copper strips (that are thin in depth and wide in width) or copper braid, wire or similar material. The bottom of the winding is fastened and electrically connected to the aluminum or similar conductive bottom plate. The end of the helix winding material is fastened using suitable wire connecting lug or conductive strip and soldered to provide a low loss electrical connection. The lug or connecting strip is fastened with a machine screw to a hole drilled into bottom plate which has been threaded to accept a machine screw. This provides a secured electrical connection. A similar fastener may be used to connect the top end of the helix winding to the helix top plate.

Figure 15C:
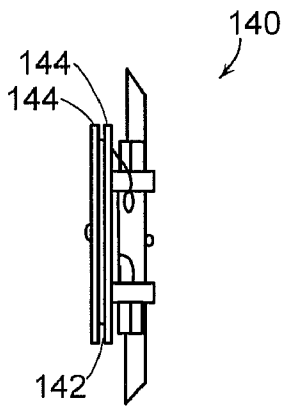
FIGS. 15A, 15B and 15C shows diagrammatic illustrative isometric, front and side views of a current enhancing unit for an antenna in accordance with an embodiment of the invention.
Figure 15B:
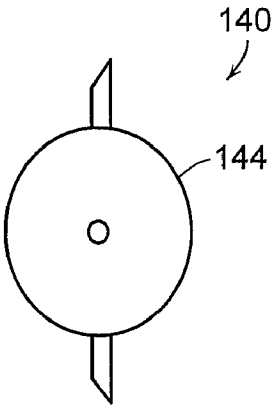
Figure 15A:
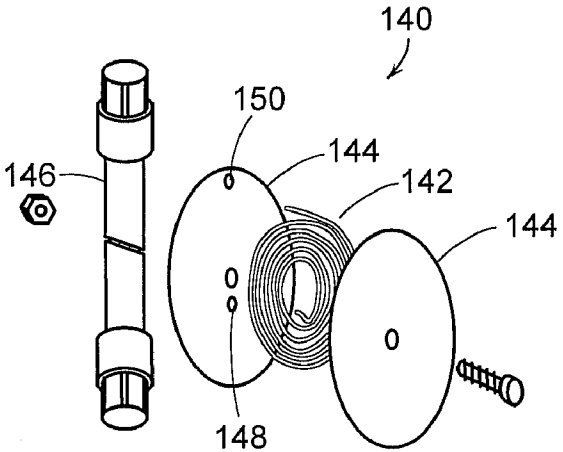
Figure 16:
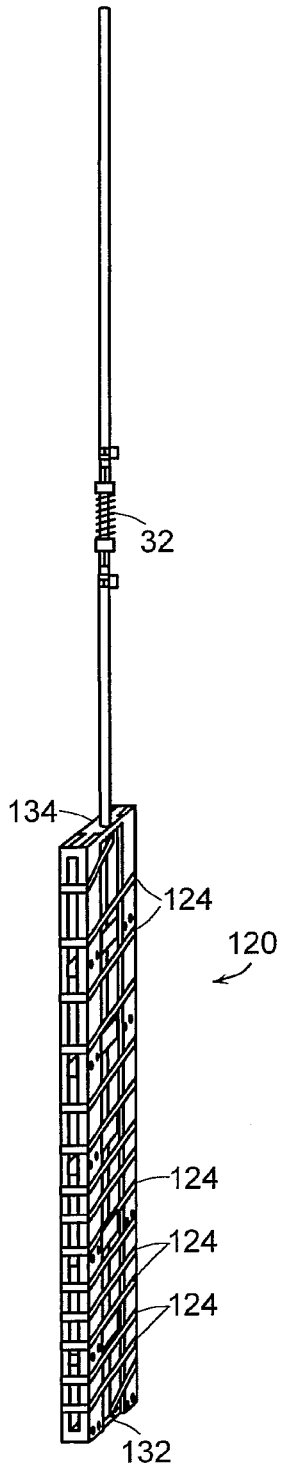
FIGS. 16 and 17 show diagrammatic illustrative side views of antennas in accordance with further embodiments of the invention employing the radiation resistance unit shown in FIG. 14.

The antenna shown in FIG. 16 may provide near ½ wave vertical antenna performance. The mid-section may be lengthened or shortened as discussed above to tune the resonance of the antenna. Similarly, the antenna shown in FIG. 17 may provide improved performance with additional bandwidth, The current enhancing unit 140 of FIG. 17 may be formed using a conductive planosprial coil 142 that is sandwiched between two non-conductive discs 144 and mounted to a non-conductive tube section 146 as shown in FIGS. 15A, 15B and 15C. The ends of the coil 142 are passed through two openings 148 and 150 in the inner disc and connected to the conductive mid-section and top-section of the antenna. Adjustment of the length of the top-section (as discussed above) may further be used to tune the antenna to resonance. In either antenna, various ratios of load coil to helix inductance may permit various performance levels of the antenna to be optimized.

When a flat antenna is designed for resonance much lower than normal, it will give ⅝ wave performance. The embodiment shown in FIG. 14 uses the flat helix but this helix is a little longer by about 10%. This allows a slightly higher inductance in the helix.

The embodiment shown may be ground mounted as discussed above using a base mounting rod. Attached to this base mounting rod may be an enclosure housing a capacitor (e.g., 22 as shown in FIG. 1) and a standard coax receptacle. The center conductor of this coax receptacle is connected to one side of the series capacitor using a short wire. The coax shield is connected electrically through the enclosure box mounting plate and clamps to the base of the antenna, mounting post and the radial/ground system. The other side of the capacitor is connected to a feed through also using a short wire from the capacitor, and this short wire exits outside the box for connection of an additional wire that is used to tap the helix base a few turns from the bottom. Also connected to the base mounting rod is a grounding wire that is connected to a ground rod. The base mounting rod is a conductive material and is driven into the ground. This rod is securely connected to the helix base plate which is also conductive. This allows grounding the base of the helix and the beginning of helix winding to the ground using the ground wire and the ground rod.

Radials are run on top of or in the ground by burying them under the surface. The radials are extended out from the base in a circular manner like the spokes extending from the hub of a wheel (similar to the hub and spoke structure of the top unit shown in FIG. 4). The radials are electrically connected to the base of the antenna through the ground rod and wire. This allows including the radials as part of the antenna ground system and serves as an electrical counterpoise.

Figure 17:
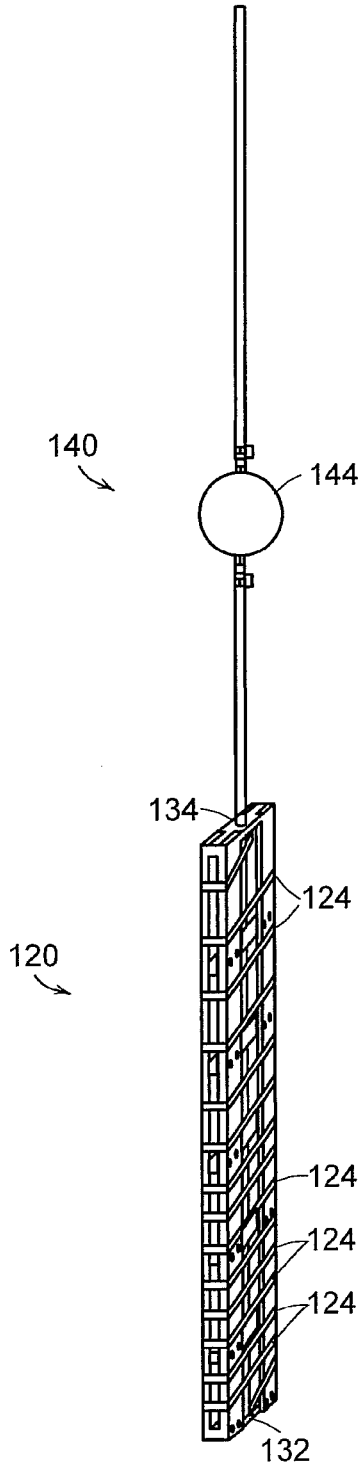

The antenna shown in FIG. 17 may be made for ¼ wave performance using suitable values of helix and load coil, together with proper dimensions of the top and bottom sections. This provides extended bandwidth performance and improved efficiency. The antenna may utilize either load coil (32 or 140), and the helix length is reduced slightly to permit the antenna to resonate just below the lower frequency of operation. In this antenna, there is no need for the capacitor coupling (22 of FIG. 1) to tune out the added inductance.

In further embodiments, antennas of the invention may be combined to form other antenna systems such as dipoles where two antennas are placed back to back and their helixes electrically connected at a mutual base. The method of connecting the radio frequency source is to tap the helix from the middle and extend to each side till a suitable match between source and load can be achieved. A balanced matching transformer or BALUN can be used to drive the feed point. In addition, the antenna may be arranged in vertical positions along the ground and formed into arrays of antenna elements providing directional transmission. Distributed loaded monopole elements combined into dipoles may be further combined to form horizontally or vertically polarized arrays such as yagis or phase driven arrays of any number of elements. Such elements may also be combined into loops providing directional characteristic with improved sensitivity compared to other loop forms.

Figure 18:
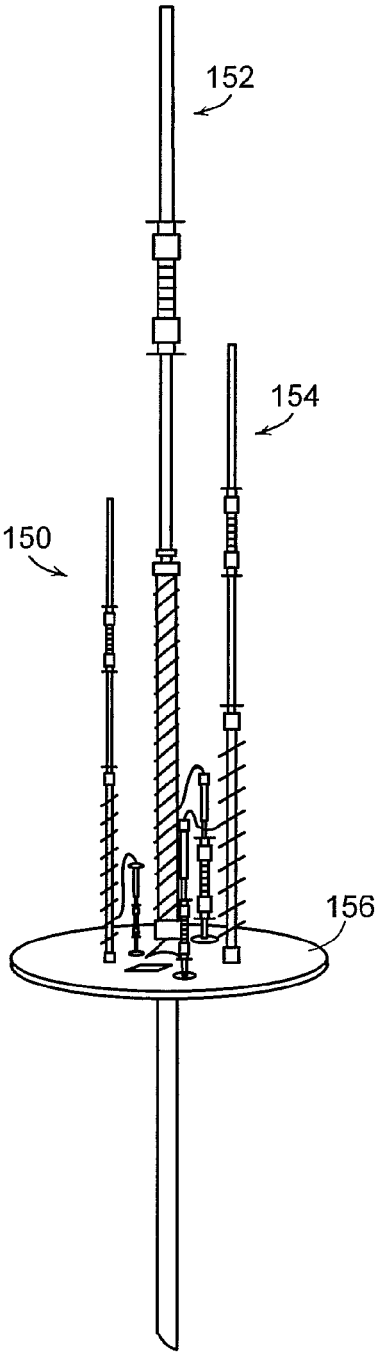
FIG. 18 shows a diagrammatic illustrative isometric view of a plurality of monopole antennas in accordance with the invention being used together in a multi-frequency system.
Figure 19:
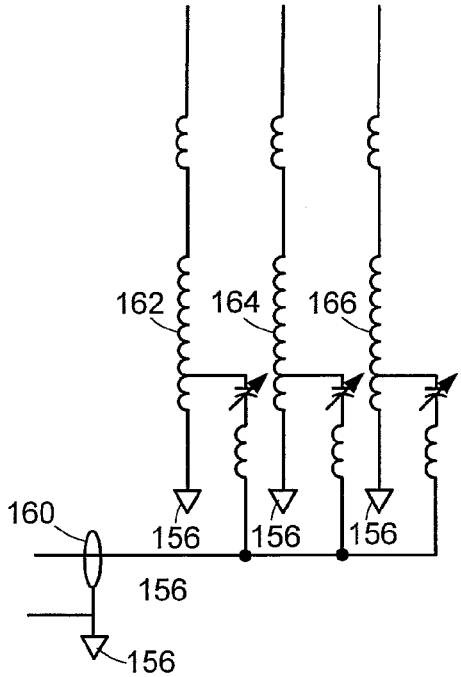
FIG. 19 shows a diagrammatic illustrative electrical schematic of a portion of the system shown in FIG. 18.

For example, as shown in FIG. 18 multiple antennas 150, 152, 154 of different resonant frequencies resulting in different physical sizes may be used together to provide a multi-frequency system on a common, electrically conductive, mounting stage 156. An equivalent electrical schematic diagram of three such antennas sharing the common mounting stage is shown in FIG. 19. This mounting stage (which may be elevated from ground) may be any conductive surface such as a vehicle or a ship or a large metal sheet such as a roof of a building. When mounting in an elevated manner using a long pole such that the antennas and the mounting surface are some height above ground, the ground radials may be used to as a counterpoise as well to stabilize the structure. It is not required that any counterpoise or radial system be resonant As shown in FIG. 19, a single coaxial feed line 160 is used from the source of radio frequency excitation. All three antennas are connected to the coaxial feed in a parallel manner. The proper selection of antenna is provided by the series tuned circuits connecting to the proper tap point on each helix 162, 164, 166. At the frequency of operation and resonance of the particular antennas selected the series resonant coupling circuits will be of sufficiently low impedance to couple the coaxial feed to the proper antenna. The series coupling elements not in use will be sufficiently de-coupled by virtue of their relatively high impedance. This configuration by virtue of this operation will provide efficient operation for each antenna to be automatically selected.

Figure 20:
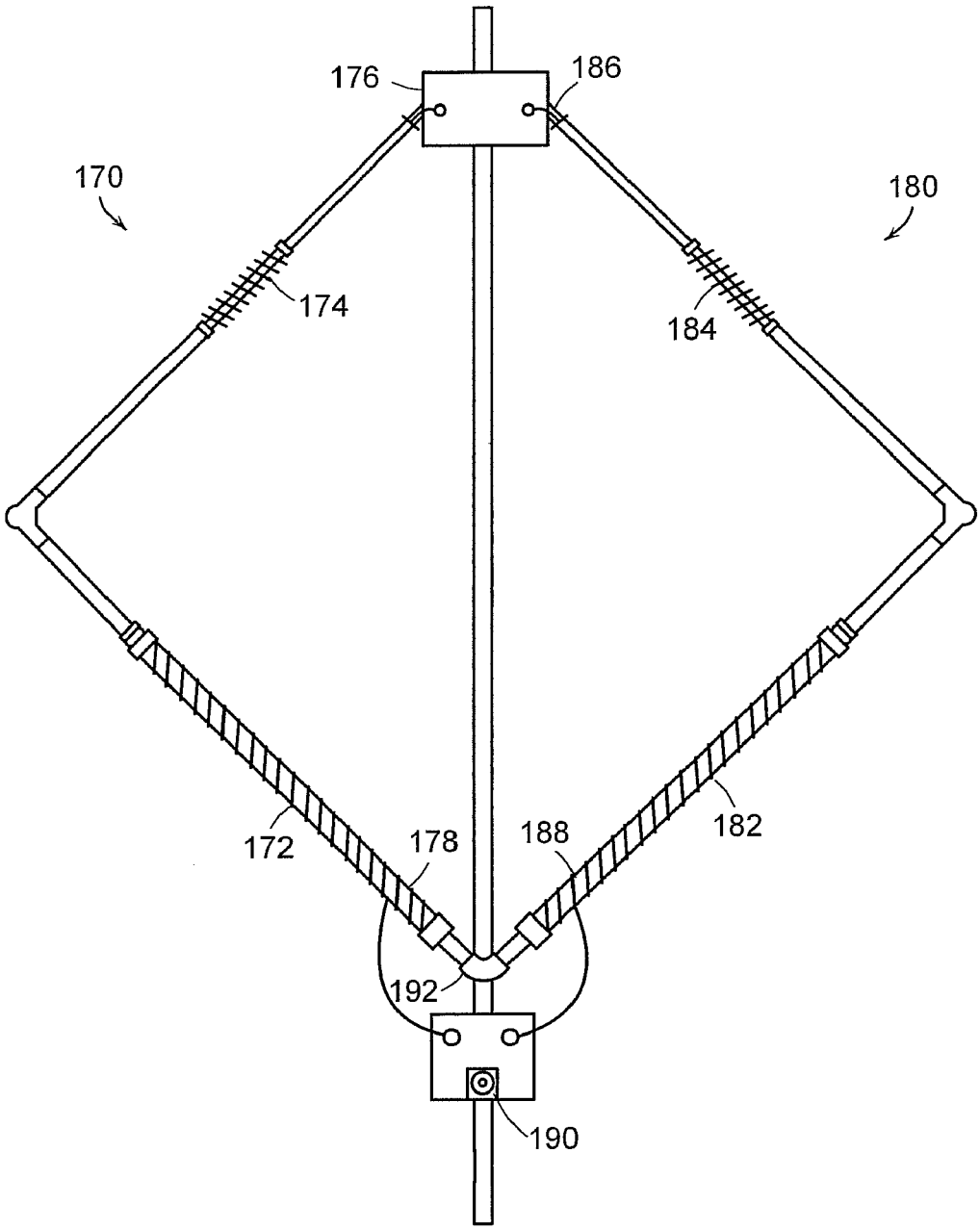
FIG. 20 shows a diagrammatic illustrative side view of an antenna in accordance with an embodiment of the invention that forms a loop antenna system.

Antennas used in accordance with further embodiments of the invention may provide a pair of distributed loaded monopole antennas as a half wave loop or two pairs may be used form a full wave loop. FIG. 20 shows two such antennas used as a half wave loop. A first antenna 170 includes a helix 172 and a load coil 174, and a second antenna 180 includes a helix 182 and a load coil 184. A variable capacitor may be coupled between the upper ends 176 and 186 of the antennas 170 and 180. The taps near the lower ends 178 and 188 of the antennas 170 and 180 may be coupled to a first balanced transformer winding while a second transformer winding is coupled to a coaxial connector port 190. In other embodiments, the end 192 of the one antenna 170 may be coupled to the first conductor of the coaxial connector 190, while the second conductor of the coaxial connector is coupled to a tap near the lower end 188 of the antenna 180.

During operation, the loop may be resonant at a higher operating frequency, and the loop may be tuned to resonance using the variable capacitor between the ends 176 and 186 of the antennas 170 and 180. If the loop is used for transmitting, the variable capacitor must be of sufficiently high voltage rating so as not to be broken down by the very large high radio frequency voltages generated across this capacitor. To implement the configuration or embodiment as shown, the midsections of each monopole element are bent into a 90-degree right angle. The bottoms of the helixes are joined using a conductive coupling. The entire loop is mounted on an insulated pole and may be rotated. The loop is feed with an unbalanced coax feed line and the transformer may be used to balance the loop. A virtual ground exists where the helix bases are joined. Because of this virtual ground the loop may be fed unbalanced while the coax shield is grounded at the helix joining point. To match the loop to the source in either case, it is only necessary to select the proper tap of the helix.

Figure 21:
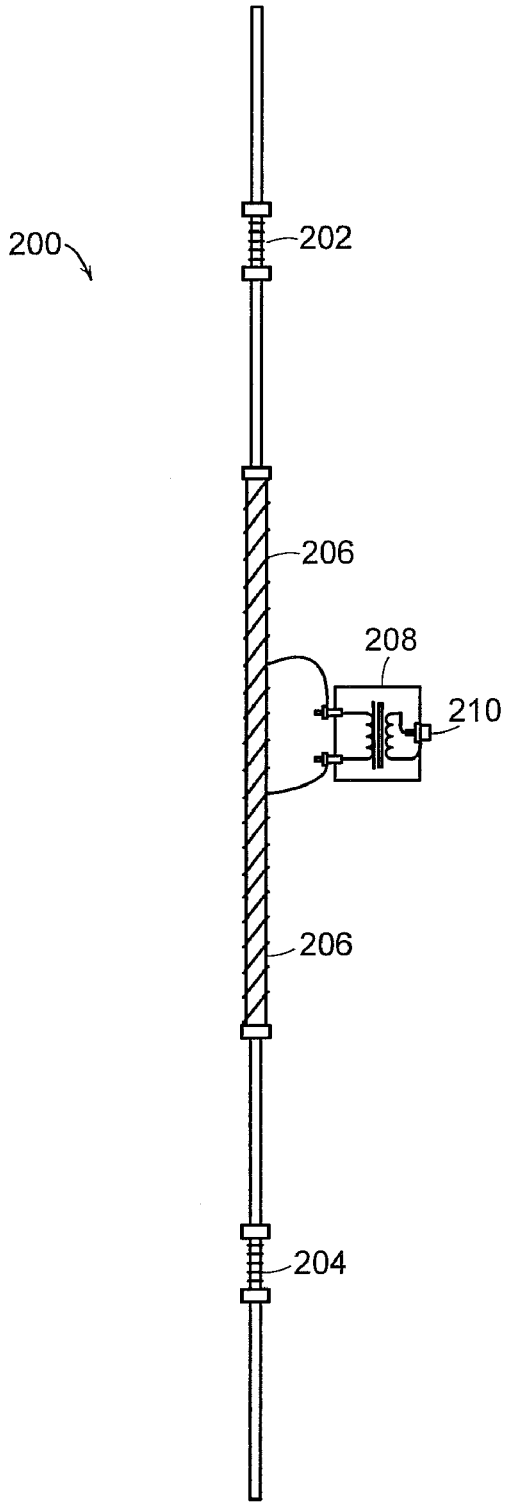
FIG. 21 shows a diagrammatic illustrative side view of an antenna in accordance with an embodiment of the invention that forms a dipole antenna system.

Antennas in accordance with various embodiments of the invention may also be coupled as a distributed loaded dipole as shown at 200 in FIG. 21. The dipole antenna 200 includes two load coils 202 and 204 that are each mutually spaced from an intermediate (double length) helix 206, which is formed by joining two helixes together at their ends. Taps taken from either side near the center of the helix are coupled to either side of a first winding of a balanced transformer 208. The second winding of the transformer is coupled to each of the two conductors of a coaxial connector 210 as shown. The transformer may be mounted in an enclosure. Selection of the proper tap points from the middle to each side of the helix winding should provide a sufficient impedance match to the radio frequency source. The transformer enclosure may be mounted a short distance from the dipole antenna and connected with short wires as indicated.

Figure 22:
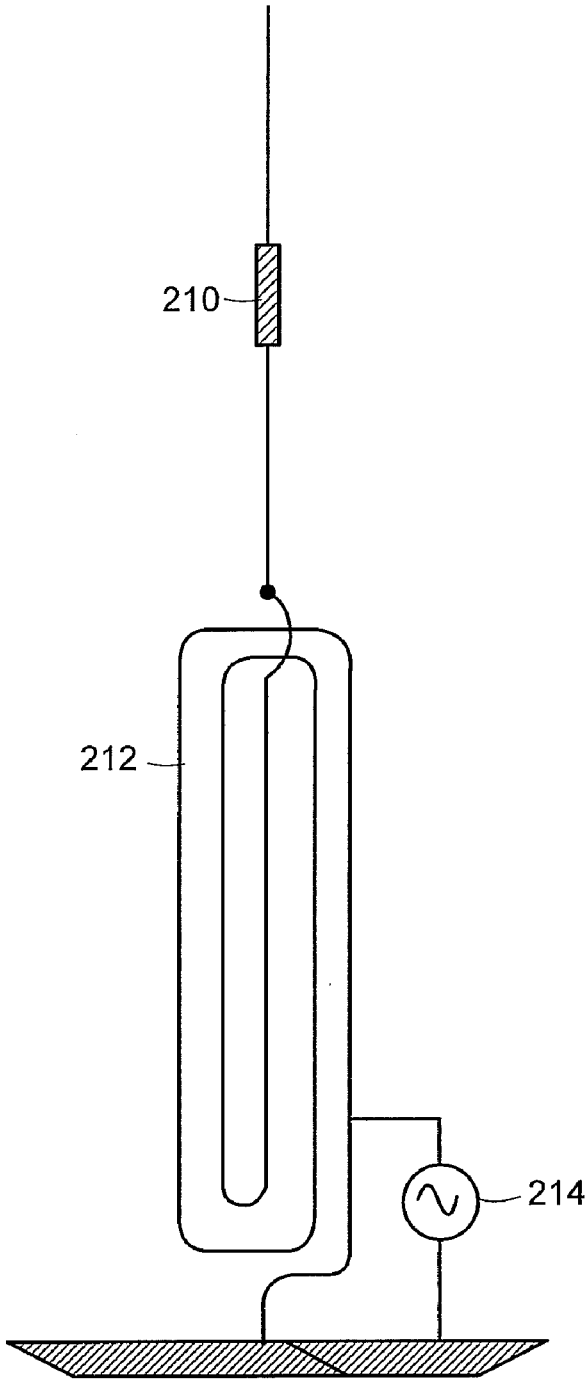
FIG. 22 shows a diagrammatic illustrative electrical schematic of an antenna in accordance with an embodiment of the invention.

Antennas in accordance with further embodiments of the invention may include a current enhancing unit 210 and a radiation resistance unit 212 wherein the radiation resistance unit 212 is not formed as a helix or even a spiral that rotates about the longitudinal axis of the antenna, but rather as a planospiral that rotates about an axis that is orthogonal to the longitudinal axis of the antenna as shown in FIG. 22. The coil of the unit 212, therefore, is formed as a coil that extends back and forth along a length of the unit 212. The antenna may be driven by a transmission signal (as indicated at 214) by tapping onto a portion of the coil of the unit 212 near but not at the ground end of the coil in unit 212.

Figure 23:
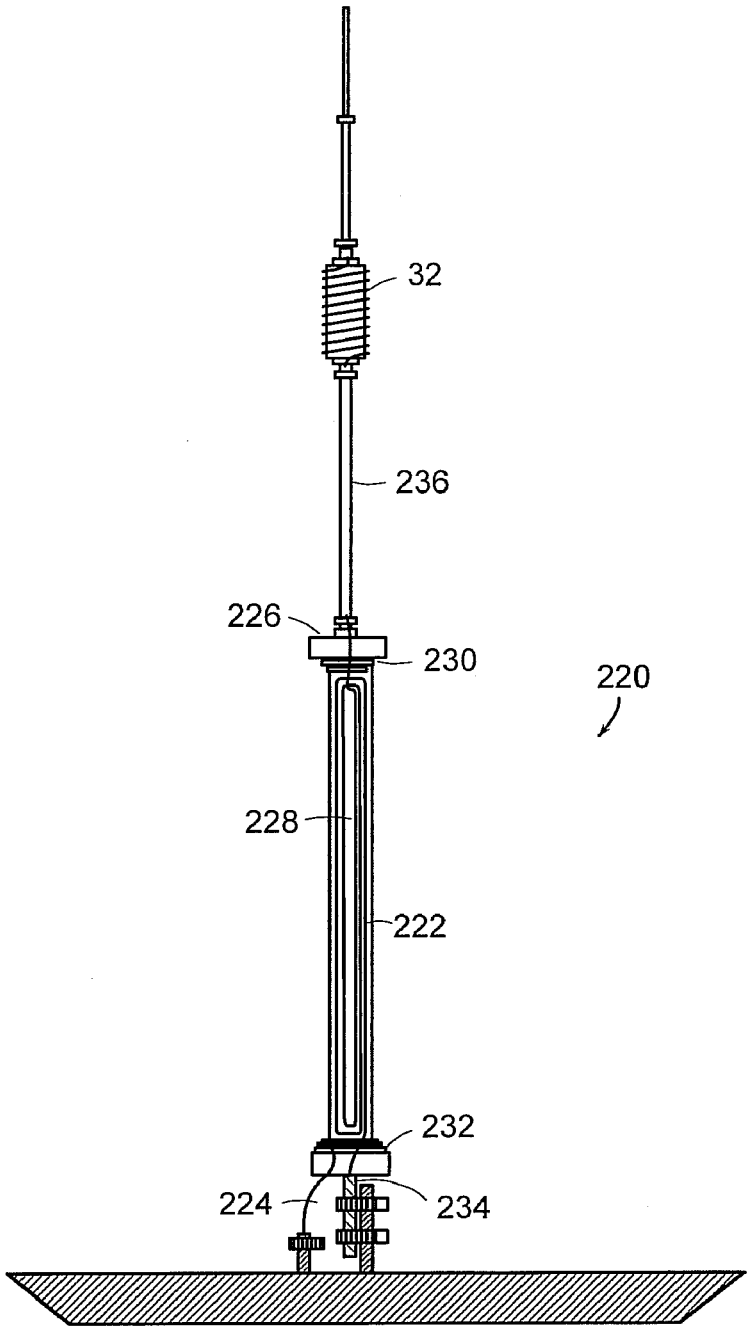
FIG. 23 shows a diagrammatic illustrative side view of an antenna in accordance with an embodiment of the invention.

For example, as shown in FIG. 23, the current enhancing unit may comprise a load coil 32 as discussed above with reference to FIG. 2. The radiation resistance unit 220, however, includes a coil 222 that extends from one end 224 (at ground) to a second end 226 by wrapping up and down the length of the unit 220 as shown in FIG. 23. The antenna includes four main parts similar to the antenna shown in FIG. 2. The current enhancing unit shown in FIG. 23 includes a central support element 228, the coil of wire 222, and coil wire stringers 230 and 232 at the top and bottom of the center support element.

Inserted into the center support element (which consists of a 1-inch square fiberglass pole) is an aluminum mounting rod 234 and a mid-section attachment rod 236. The coil wires 222 are strung vertically along the support element 228 to form an elongated spiral loop. This loop is fastened to the mid-section 236 using solder lugs and bolted to the mid-section attachment rod. The mid-section is attached by slipping this mid section tubing over the attachment rod and clamping them together using clamps. The lower part of the loop is attached to the aluminum mounting post 234 using wire lugs that arc screwed into the mounting post through the fiberglass main support holding the wire coil 222. The ground wire is clamped to the ground rod using a ground damp. In further embodiments, a false winding may also be added to the unit 220 as discussed above with reference to FIGS. 6 and 7.

The performance of this antenna as shown in FIG. 2 at 7 MHz has been measured and it compared well with a ¼ wave antenna. This full size antenna is 33 feet in height and this antenna with a plano spiral radiation resistance unit is ⅓ this size or approximately 11 feet in height. Both antennas were mounted on the same ground system and fed with the same power as measured at the base of each antenna. A driving power of 1 watt was used. Measured levels of radiating signal strength were so close to a ¼ wave measured signal strength that the two antennas appear to be equal in radiating performance.

The current profile was measured using an indirect current sensor, and it compared well with a current profile for the antenna of FIG. 2 employing a three dimensional helix. The antenna of FIG. 23 appeared to provide uniform current distribution.

One feature of the design of an antenna such as that shown in FIG. 2, is that normally an antenna of such a size as discussed above requires 25 μH of combined helix and load coil inductance to resonate at 7 MHz. This also requires considerable lengths of wire (about 42 feet for the helix and 20 feet or so for the load coil). The planospiral design uses 10% less wire and is resonant at 7 MHz using 10% less inductance. The planospiral helix appears to make better use of distributed capacity loading to ground than does the standard DLM. This has also been noticed in the three dimensional flat board-like frame helix used with planospiral load coils. Due to better utilization of distributed loading techniques by the piano spiral antenna, it may achieve better efficiency and wider bandwidth especially when utilizing the false helix winding. The system of FIG. 23 also appears to provide excellent linearity of the amplitude and phase and the relative linear progression of reactive to non reactive changeover in the antenna through the bandwidth.

Certain of the above distributed loaded monopole antennas utilizes a helix with a load coil to improve the radiated efficiency of the helix and antenna overall. The addition of the load coil raises the radiation resistance of the antenna, increases and makes uniform the current distribution along the antenna, and increases the useful bandwidth of the antenna. These structures, though practical and useful for many ranges of frequency applications (such as very low, low, medium, high and very high frequency systems), present practical limitations for ultra high frequency and microwave radio frequency applications. For example, a 1000 MHz system might require a helix that is eight thousandths of an inch in diameter and 0.3 inches in length of which upwards of 100 turns of very fine wire must be wound.

Figure 26:
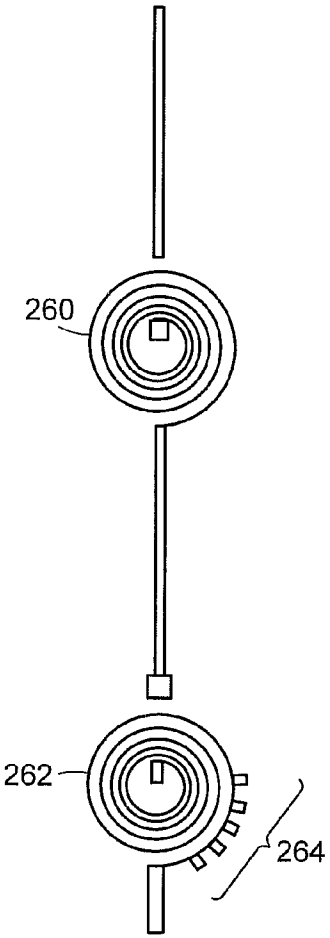
FIGS. 24, 25 and 26 show diagrammatic illustrative side views of antennas in accordance with further embodiments of the invention.
Figure 25:
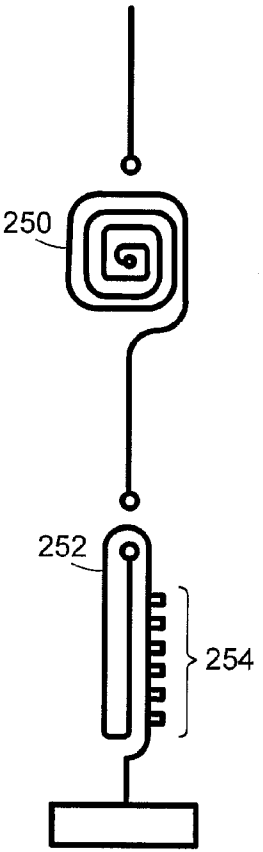
Figure 24:
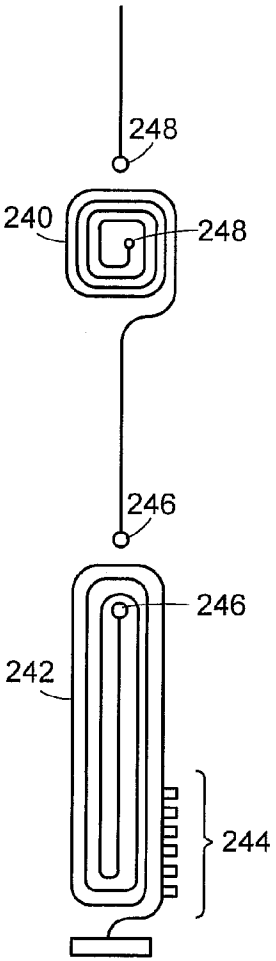

Applicant has further discovered that a plano-spiral antenna may be created in accordance with a further embodiment of the invention that provides coils fabricated in two planes. In further embodiments, such an antenna may be scaled to provide operation at ultra high frequencies and microwave radio frequencies by providing a similarly planar load coil 240 and radiation resistance unit coil 242 on a printed circuit board as shown in FIG. 24. The coil 242 may also include a plurality of tap points 244 for easy matching to a standard feed line. The circuit provides a continuous conductive path through the pass through holes shown at 246 and 248 as is well known in the art. In further embodiments, fewer windings on the load coil 250 and radiation resistance coil 252 with taps 254 may be used as shown in FIG. 25, and the load coil 260 and radiation resistance coil 262 with taps 264 may be formed in many difference shapes such as circular spirals as shown in FIG. 26.

Such antennas may be suitable for applications such as radio frequency identification tags (RFID) at high frequencies. It is expected that these may be implemented on a silicon substrate of a very small scale, providing for example a ¼ wave antenna up to or above 4.2 GHz.

For example, the helix inductance for an antenna at 100–200 MHz may be 0.131 μH or 131 nH, and the load coil inductance may be 0.211 or 211 nH. The helix to load coil ratio for inductance is 1.61. To be a true ¼ wave distributed loaded monopole antenna the load coil to helix inductance ratio should be 1.4–1.7.

Another such antenna that is ½ the physical size was also measured, and the helix inductance for the antenna may be 0.088 μH or 88 nH, and the load coil inductance may be 0.135 or 135 nH. The helix to load coil ratio for inductance is 1.56. This resulted in an antenna with a resonance around about 400–500 mH.

Those skilled in the art will appreciate that numerous modifications and variations may be made to the above disclosed embodiments without departing from the spirit and scope of the invention.

What is claimed is:

1. A distributed loaded antenna system including a monopole antenna comprising:

a radiation resistance unit coupled to a transmitter base, said radiation resistant unit including a radiation resistance unit base that is coupled to ground;

a current enhancing unit for enhancing current through said radiation resistance unit; and a conductive mid-section intermediate said radiation resistance unit and said current enhancing unit, said conductive mid-section having a length of about 0.025 λ where λ is the wavelength of the signal to be radiated by the antenna system.

2. The distributed loaded antenna system as claimed in claim 1, wherein said radiation resistance unit includes a helix.

3. The distributed loaded antenna system as claimed in claim 1 wherein said radiation resistance unit includes a planar spiral coil winding.

4. The distributed loaded antenna system as claimed in claim 1, wherein said current enhancing unit includes a load coil.

5. The distributed loaded antenna system as claimed in claim 1, wherein said current enhancing unit includes a planar spiral coil winding.

6. The distributed loaded antenna system as claimed in claim 1, wherein said current enhancing unit includes a top unit.

7. The distributed loaded antenna system as claimed in claim 6, wherein said top unit includes a conductive hub and spoke structure.

8. The distributed loaded antenna system as claimed in claim 6, wherein said top unit includes a planar spiral coil winding.

9. The distributed loaded antenna system as claimed in claim 1, wherein said antenna is printed in a printed circuit board.

10. The distributed loaded antenna system as claimed in claim 1, wherein said antenna includes an adjustment unit for adjusting either the radiation resistance unit or the current enhancing unit.

11. The distributed loaded antenna system as claimed as claim 10, wherein said adjustment unit includes a slotted tube.

12. The distributed loaded antenna system as claimed in claim 11, wherein said adjustment unit further includes a tapered sleeve.

13. The distributed loaded antenna system as claimed in claim 1, wherein said radiation resistance unit has a first inductance and said current enhancing unit has a second inductance that is greater than said first inductance.

14. The distributed loaded antenna system as claimed in claim 13, wherein a ratio of said second inductance to said first inductance is in the range of about 1.1 to about 2.0.

15. The distributed loaded antenna system as claimed in claim 13, wherein a ratio of said second inductance to said first inductance is in the range of about 1.4 to about 1.7.

16. The distributed loaded antenna system as claimed in claim 1, wherein said antenna further includes a false winding that is electrically decoupled from the antenna at each end therefore, and is positioned within the radiation resistance unit between alternating windings of a conductor coil in said radiation resistance unit.

17. The distributed loaded antenna system as claimed in claim 1, wherein said transmitter base includes a coupling to ground, and a base of said radiation resistance unit is connected to ground.

18. A distributed loaded antenna system including a monopole antenna comprising:

a radiation resistance unit coupled to a transmitter base;

a current enhancing unit for enhancing current through said radiation resistance unit; and a conductive mid-section intermediate said radiation resistance unit and said current enhancing unit, said radiation resistance unit having a first inductance and said current enhancing unit has a second inductance that is greater than said first inductance.

19. The distributed loaded antenna system as claimed in claim 18, wherein a ratio of said second inductance to said first inductance is in the range of about 1.1 to about 2.0.

20. The distributed loaded antenna system as claimed in claim 18, wherein a ratio of said second inductance to said first inductance is in the range of about 1.4 to about 1.

21. A distributed loaded antenna system including a monopole antenna comprising:

a radiation resistance unit coupled to a transmitter base;

a current enhancing unit for enhancing current through said radiation resistance unit; and a conductive mid-section intermediate said radiation resistance unit and said current enhancing unit, wherein said radiation resistance unit is formed of a planospiral conductor material.

22. The distributed loaded antenna system as claimed in claim 21, wherein said planospiral conductor material is generally rectangularly shaped.

23. The distributed loaded antenna system as claimed in claim 21, wherein said planospiral conductor material is generally circularly shaped.

24. A distributed loaded antenna system including a monopole antenna comprising:

a radiation resistance unit coupled to a grounded transmitter base;

a signal input tab coupled to said radiation resistance unit;

a current enhancing unit for enhancing current through said radiation resistance unit; and a conductive mid-section intermediate said radiation resistance unit and said current enhancing unit.

25. The distributed loaded antenna system as claimed in claim 24, wherein said radiation resistance unit includes a helix.

26. The distributed loaded antenna system as claimed in claim 24, wherein said current enhancing unit includes a load coil.

27. The distributed loaded antenna system as claimed in claim 24, wherein said current enhancing unit includes a top unit having a hub and spoke structure.

28. The distributed loaded antenna system as claimed in claim 24, wherein said antenna includes an adjustment unit for adjusting either the radiation resistance unit or the current enhancing unit.

29. The distributed loaded antenna system as claimed in claim 24, wherein said radiation resistance unit has a first inductance and said current enhancing unit has a second inductance that is greater than said first inductance.

* * * * *

UNITED STATES PATENT AND TRADEMARK OFFICE

CERTIFICATE OF CORRECTION

PATENT NO. : 7,187,335 B2
APPLICATION NO. : 11/139284
DATED : March 6, 2007
INVENTOR(S) : Robert J. Vincent It is certified that error appears in the above-identified patent and that said Letters Patent is hereby corrected as shown below:

Col. 14, line 47, delete “resistant” and replace with --resistance--.

Col. 16, line 6, delete “to about 1” and replace with --to about 1.7--.

Signed and Sealed this

Seventeenth Day of April, 2007

JON W. DUDAS
*Director of the United States Patent and Trademark Office*

UNITED STATES PATENT AND TRADEMARK OFFICE

CERTIFICATE OF CORRECTION

PATENT NO. : 7,187,335 B2
APPLICATION NO. : 11/139284
DATED : March 6, 2007
INVENTOR(S) : Robert J. Vincent It is certified that error appears in the above-identified patent and that said Letters Patent is hereby corrected as shown below:

In Col. 14, line 47, please delete "resistant" and replace with --resistance--.

In Col. 16, line 6, please delete "to about 1" and replace with --to about 1.7--.

Signed and Sealed this

Twenty-fourth Day of April, 2007

JON W. DUDAS
*Director of the United States Patent and Trademark Office*